US005970754A

United States Patent [19]

Polato

[11] Patent Number: 5,970,754

[45] Date of Patent: Oct. 26, 1999

[54] DEVICE FOR CONTINUOUSLY ADJUSTING THE WORKING PRESSURE FOR STAKING MACHINES WITH BEATING PLATES

[75] Inventor: Antonio Polato, Mussolente, Italy

[73] Assignee: Officine di Cartigliano S.P.A., Italy

[21] Appl. No.: 08/925,801

[22] Filed: Sep. 9, 1997

[51] Int. Cl.[6] ..... C14B 1/40

[52] U.S. Cl. ..... 69/34; 69/19.1; 100/257

[58] Field of Search ..... 69/33, 1, 1.5, 46, 69/47, 48, 19, 19.1, 19.3, 34; 100/257, 282

[56] References Cited

U.S. PATENT DOCUMENTS

| | | | |
|---|---|---|---|
| 2,889,507 | 6/1959 | Kennedy et al. | 100/257 |
| 3,398,557 | 8/1968 | Dokoupil et al. | 69/33 |
| 3,400,625 | 9/1968 | Wrona | 100/257 |
| 3,677,041 | 7/1972 | Dokoupil | 69/33 |
| 5,184,487 | 2/1993 | Corner | 69/19.1 |
| 5,746,122 | 5/1998 | Gietz et al. | 100/257 |

FOREIGN PATENT DOCUMENTS

| | | | |
|---|---|---|---|
| 368233 | 5/1990 | European Pat. Off. | 69/19.1 |
| 504579 | 9/1992 | European Pat. Off. | 69/19.1 |
| 1247078 | 3/1991 | Italy . | |

*Primary Examiner*—Michael A. Neas
*Attorney, Agent, or Firm*—R. Neil Sudol; Henry D. Coleman

[57] ABSTRACT

A device for automatically adjusting the staking pressure in staking machines with beating plates, wherein the machine includes at least one fixed plate (5) and at least one moving plate (4) which face each other and are provided with complementarily shaped tools; the fixed plate (5) is installed on threaded posts (11) which can be screwed in complementarily threaded bushes (12) which are rigidly coupled to a bed (3); there are locking devices (13) which act selectively on the fixed plate (5). The device includes at least one servomechanism (16) which is rigidly coupled to the fixed plate (5) and is connected to the threaded posts (11) for their automatic rotation; sensor devices (23) for detecting the value of the maximum penetration of the tools and for generating a first electrical signal; electronic control devices (24) for comparing the first electrical signal with a second presettable electrical signal which corresponds to the intended staking pressure and for continuously adjusting the power supply of the servomechanism. The servomechanism (16) consists of a gearmotor which is connected to the threaded posts (11) by virtue of a toothed belt and a chain.

17 Claims, 4 Drawing Sheets

DEVICE FOR CONTINUOUSLY ADJUSTING THE WORKING PRESSURE FOR STAKING MACHINES WITH BEATING PLATES

BACKGROUND OF THE INVENTION

1. Field of the Invention

The present invention is used in the field of tannery and relates in particular to a device for automatically adjusting the working pressure which can be installed in staking machines with beating plates for stretching and softening industrial hides and similar products.

2. Description of the Prior Art

A conventional staking machine is essentially constituted by one or more pairs of facing plates which can move with respect to each other and have tools which interact alternately with the hides to be treated whilst they are moved substantially at right angles to the reciprocating motion of the plates by virtue of two adjacent conveyor belts.

At least one of the plates is connected, by virtue of a system of the cam-and-linkage type, to a flywheel mass which is rotated by an electric motor so as to promote a periodic motion toward and away from the other plate.

An example of these conventional machines is disclosed in IT-1,247,078, to which reference is made for a detailed description of the various parts, and by the staking machine model PAL-3200 with multiple heads, manufactured by Officine di Cartigliano, S.p.A., assignee of the present application.

In these conventional machines, the tools of one of the mutually opposite plates are generally constituted by projections or pins, whilst those of the other plate are constituted by hollows or similar cavities. The depth of the penetration of the pins in the hollows determines the staking or working "pressure" of the hides.

In order to vary the staking pressure, for example to adapt it to a different kind of hide or treatment, it is necessary to vary the relative position of the plates by making one adjustable in terms of height and angle with respect to the other. For this purpose, the fixed upper plate is peripherally supported by four threaded posts or worm screws which screw into respective complementarily threaded bushes anchored to the frame, so as to move the upper plate toward or away from the bed and therefore toward and away from each other. In order to stably lock the plate once it has been adjusted, there are locking devices constituted by two lateral hydraulic jacks, which act parallel to the axis of the worm screws so as to prevent their rotation within the bushes.

Normally, the worm screws are rotated manually and discontinuously in steps which correspond to translatory motions of approximately 1 mm, using a vernier scale formed on the upper end of the worm screws.

In practice, in order to perform the adjustment it is necessary to perform the following operations: a) stop the conveyor belts of the hides and the motor that drives the flywheel mass until the machine comes to a complete stop; b) depressurize the jacks in order to release the worm screws; c) rotate the worm screws stepwise so as to adjust the height of the fixed plate; d) pressurize the jacks in order to lock the worm screws in the intended position; e) restart the machine and bring it to its normal operating condition. All this entails a considerable waste of time and most of all entails halting work on the machine for a few minutes. If one considers that these operations must sometimes be repeated several times before achieving optimum adjustment, it is evident that they have a considerable negative effect during a day's work and on the entire production cycle, especially for subcontractors and small tanneries.

The disadvantage of being able to perform adjustment discontinuously but not continuously is furthermore evident.

Staking machines are known which have systems for automatically adjusting the staking pressure which however are considerably complicated and require the machine to be designed for this purpose. In other words, with current solutions it is not possible to modify an existing manually-adjusted machine in order to equip it with a continuous and automatic adjustment and avoid stopping it.

An aim of the present invention is to overcome the above drawbacks by providing a device which allows one to automatically adjust, during treatment, the staking pressure in staking machines with beating plates without having to stop the machine.

An object of the present invention is to provide a device which allows a drastic reduction in adjustment times.

A further object is to allow practically continuous staking pressure adjustment or in any case an adjustment which has a very fine resolution.

Still a further object is to provide a device which can be installed on any existing machine of the manually-adjusted type.

SUMMARY OF THE INVENTION

This aim, these objects and others which will become apparent hereinafter are achieved by a device for continuously adjusting the operating pressure in a machine for processing leather and industrial hides. The machine comprises at least one fixed plate and at least one moving plate which face each other and are provided with complementarily shaped tools, wherein the fixed plate is installed on threaded posts which can be screwed in complementarily threaded bushes which are rigidly coupled to a bed. Locking devices are provided which act selectively on the fixed plate in order to lock it in the intended position. The device for adjusting the operating pressure in this leather and hide processing machine includes a servomechanism which is rigidly coupled to the fixed plate and is connected to the threaded posts for the automatic rotation thereof; sensor devices for detecting the value of the maximum penetration of the tools and for generating a first electrical signal; electronic control devices for comparing the first electrical signal with a second presettable electrical signal which corresponds to the intended staking pressure and for continuously adjusting the power supply of the servomechanism.

In a first embodiment, the servomechanism is of the electromechanical type and consists of at least one gearmotor which is connected to the threaded posts by virtue of flexible transmission devices.

In an alternative embodiment, the servomechanism is of the hydraulic or pneumatic type and consists of at least one cylinder with a through stem which is connected to the threaded posts by virtue of flexible transmission devices.

Preferably, the flexible transmission devices consist of a toothed belt or of a chain.

BRIEF DESCRIPTION OF THE DRAWINGS

Further characteristics and advantages will become apparent from the detailed description of some preferred but not exclusive embodiments of a device for adjusting staking pressure according to the invention, which are illustrated by way of non-limitative example with the aid of the accompanying drawings, wherein.

DESCRIPTION OF THE PREFERRED EMBODIMENTS OF THE INVENTION

Figure 1:
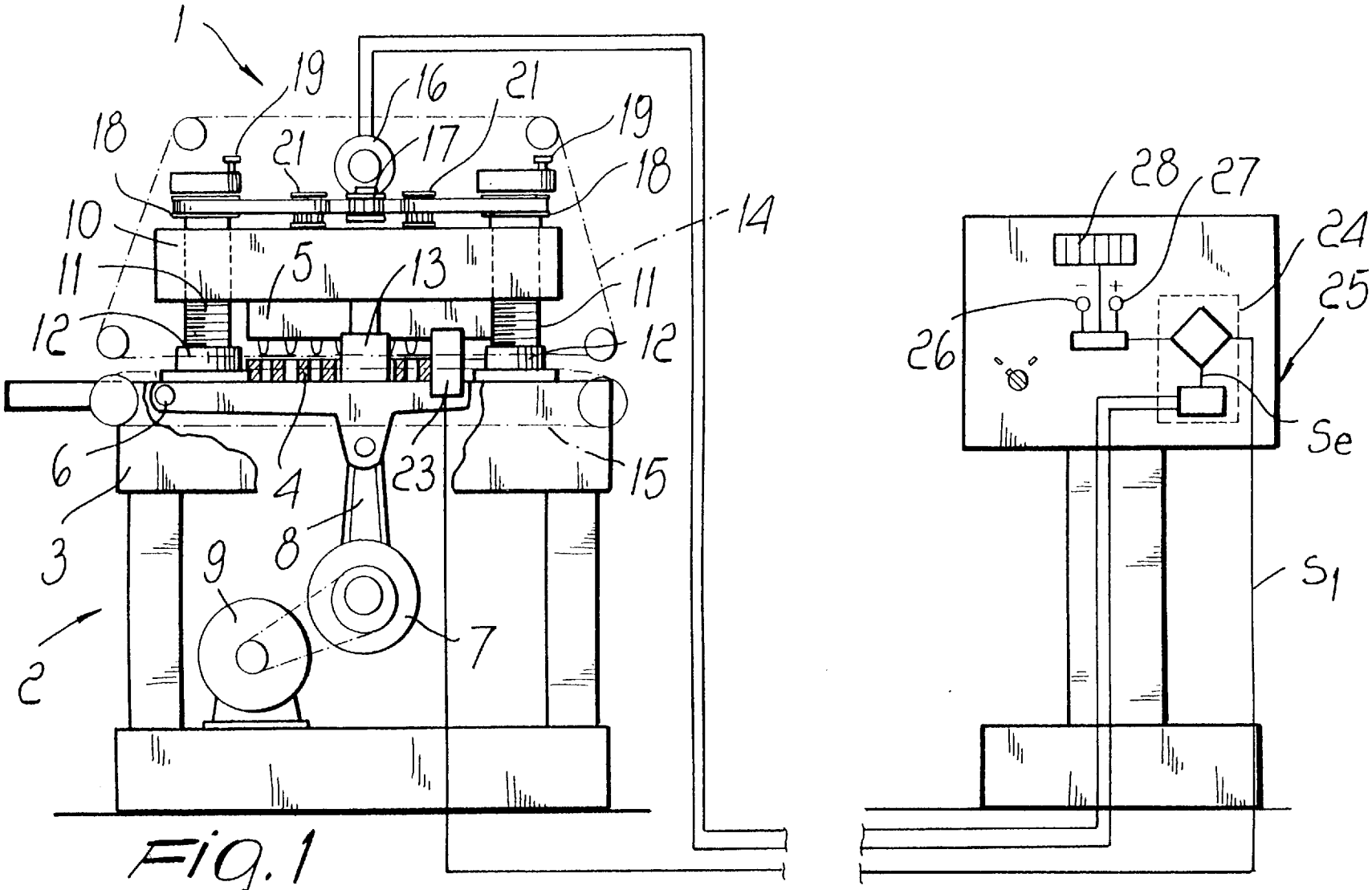
FIG. 1 is a schematic side view of a first embodiment of the device for adjusting staking pressure according to the invention, applied to a staking machine with a single pair of beating plates.

With reference to the above figures, a staking pressure adjustment device according to the invention is illustrated and generally designated by the reference numeral 1; the device is installed on a staking machine 2 with beating plates, for example of the type manufactured by Officine di Cartigliano S.p.A., model no. PAL 3200, with two heads. For the sake of simplicity in presentation, the machine has been shown with a single head instead of two, since the second head is perfectly identical to the first one.

In a per se known manner, the machine 2 includes a bed 3 on which there is a movable lower plate 4, provided with tools shaped like hollows, and a fixed upper plate 5 with pin-shaped tools which are aligned with the hollows of the lower plate 4.

The movable lower plate 4 is hinged to the bed at 6, so that it can oscillate substantially vertically, cooperating with the upper plate 5 to stretch the hides, and is eccentrically connected to a flywheel mass 7 by a linkage 8. The flywheel mass 7 is rotated by an electric motor 9. The upper plate 5 is anchored to a tubular beam 10, which is installed on the bed by means of four threaded posts 11 which are arranged at the corners of the beam and can rotate but cannot perform translatory motions with respect to the beam. The threaded posts 11 are screwed into threaded bushes 12 which are rigidly coupled to the bed 3.

Two jacks 13 are interposed between the bed 3 and the beam so as to raise it, selectively locking the rotation of the threaded posts 11 with respect to the bushes 12.

Two facing motorized conveyor belts 14 and 15 are installed on the bed 3 and move concordantly so as to advance the hides P transversely to the working direction of the plates.

According to the invention, the adjustment device 1 includes a gearmotor which is installed on the fixed upper plate 5 and is connected to the threaded posts 11 for the automatic rotation thereof; sensor devices for detecting the value of the maximum penetration of the tools, transducing it into a first electrical signal; electronic control devices for comparing the first electrical signal with a second preset-table electrical signal, which corresponds to the intended staking pressure, and for continuously adjusting the power supply of the gearmotor.

Figure 2:
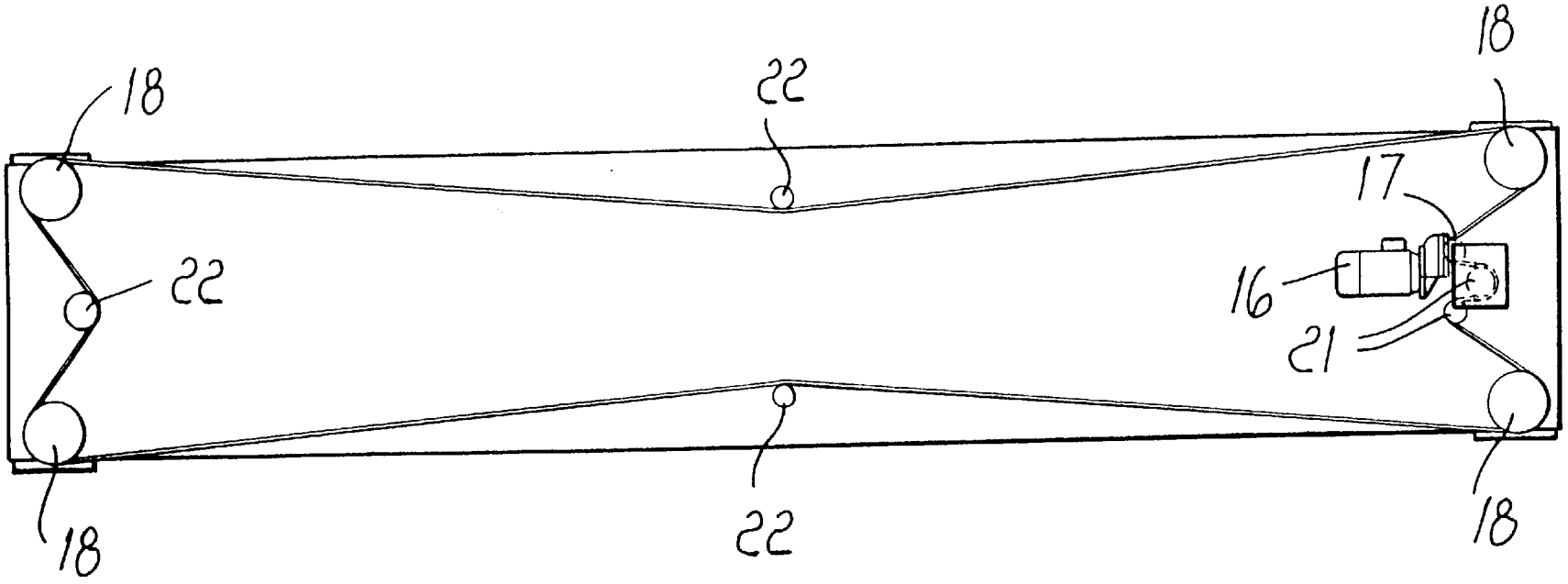
FIG. 2 is a plan view of the mechanical part of the device of FIG. 1.
Figure 3:
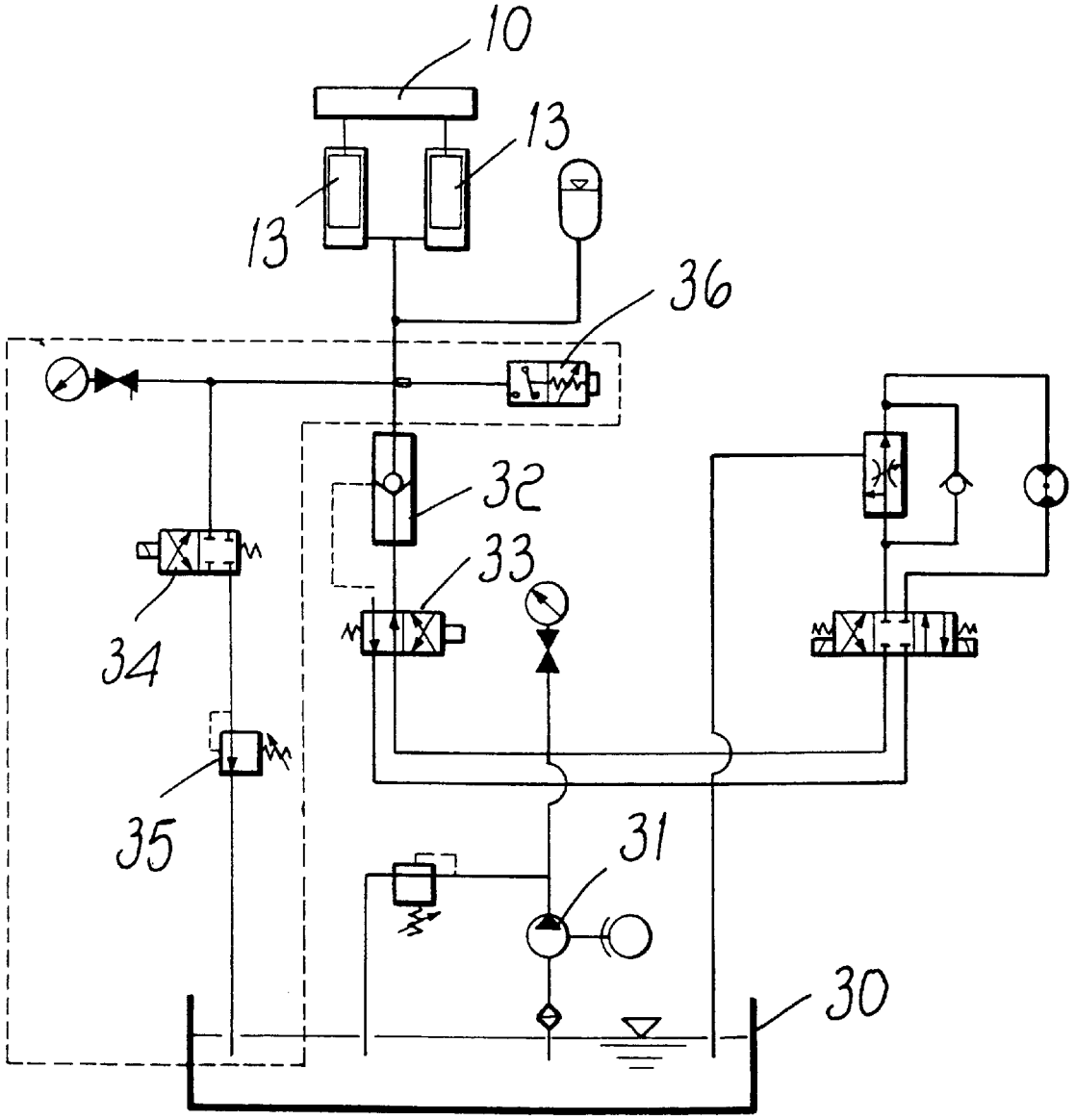
FIG. 3 is a diagram of the hydraulic part of the device of the preceding figures.

As shown more clearly in FIG. 2, a bidirectional electric gearmotor 16 is installed on the beam 10 and has a toothed sprocket 17. Each threaded post 11 is provided, at the top, with coaxial toothed pulleys 18 which can be coupled and uncoupled with respect to the respective post by means of bolts 19 which can be opened.

The pulleys 18 are connected to the sprocket 17 of the gearmotor 16, preferably by means of a flexible transmission device such as a belt or chain. In particular, it is possible to use a toothed belt 20, which is tensioned by means of guiding pulleys 21 and belt tensioner rollers 22.

In this manner, the rotation of the servomotor 16 causes the synchronous rotation of the pulleys 18, which turn all the threaded posts 11, performing the vertical adjustment of the beam 10 and therefore of the upper plate 5.

Electronic control devices are provided to adjust the minimum distance between the plates and accordingly the staking pressure, which is proportional to this distance.

The electronic control devices can be constituted by at least one potentiometric position transducer 23, which is interposed between the plates 4 and 5 and is suitable to detect their minimum distance and transduce it into a first electrical signal S1. This first electrical signal is sent to a differential circuit 24 of a per se known type, which is inserted in a control panel 25, for comparison with a second electrical signal S2 which is preset by the operator by virtue of two buttons 26 and 27 and is visualized on a digital display 28. The error signal adjusts the power supply of the (gearmotor 16 so as to provide the preset value of the minimum distance between the plates. Adjustment can be performed by minimum steps of approximately 0.1 mm, that is to say, with ten times the accuracy of conventional manual machines.

In order to adjust the inclination of the plate 5, it is possible to disengage the bolts 19, allowing the manual rotation of the posts 11 in order to adjust each one.

The power supply circuit of the locking jacks 13 is provided with a series of standard components, such as an oil reservoir 30, a pump 31, a check valve 32 and a main flow control valve 33, which are common to conventional machines that do not have an automatic adjustment device.

With respect to the conventional machine, there is also a controlled electric valve 34, which is arranged along the return line of the power supply circuit of the jacks 13 in order to discharge the fluid toward the reservoir 30; a pressure reduction valve 35, which is arranged downstream of the controlled electric valve 34 in order to keep the pressure at a minimum value which is set so as to balance the weight of the fixed plate 5 and of the beam 10, minimizing the force required to rotate the threaded posts 11. In this condition, the upper plate 5 is in a standby condition in order to perform automatic adjustment by means of the gearmotor 16 and the associated electronic control systems.

In order to avoid damage to the adjustment system, there is also a differential pressure switch 36, which is suitable to detect the pressure in the power supply circuit of the jacks and to allow the supply of electric power to the gearmotor 16 only at this minimum pressure.

Figure 4:
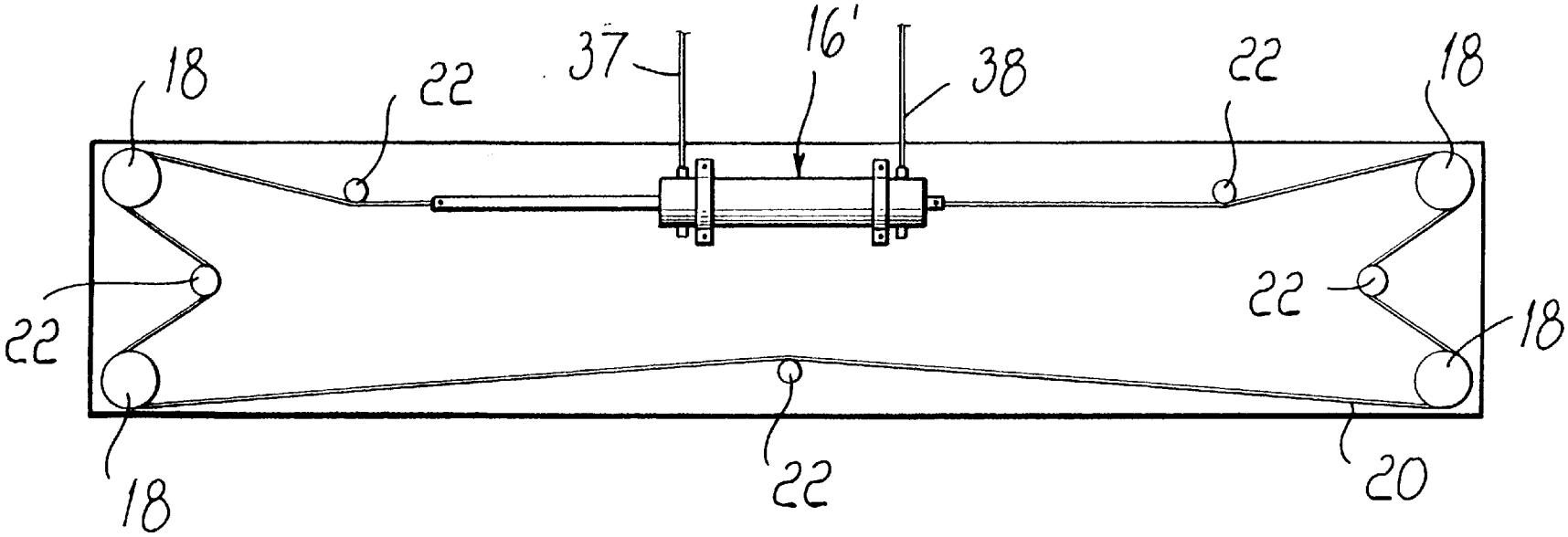
FIG. 4 is a plan view of a second embodiment of the device according to the invention.

FIG. 4 is a schematic top view of a variation of the device according to the invention, in which the components which are similar to those of FIG. 2 have been designated by the same reference numerals. This variation differs from the one of FIG. 2 essentially in that instead of the bidirectional electric gearmotor 16 a servomechanism of the hydraulic or pneumatic type 16' is provided, preferably constituted by a double-action cylinder provided with a through stem. In particular, supply and discharge ducts 37 and 38, at the ends of the cylinder 16', are connected to a hydraulic control unit, which is not shown in the drawings but is known to the person skilled in the art.

During use, the operator does not stop the machine but places the upper plate 5 in a balanced or standby position; then he adjusts the distance between the plates and the staking pressure by means of the buttons 26 and 27, reading the resulting value on the display 28; he optionally releases the bolts 19 and manually adjusts the inclination by acting on each individual post; finally, he returns the pressure of the jacks to the normal operating value and resumes work.

Practical tests have shown that the time required for these operations is between approximately 30 and 60 seconds.

From the above description it is evident that the device according to the invention achieves the intended aim and all the objects; in particular, attention is drawn to the continuous and accurate automatic adjustment of the staking pressure without having to stop the machine, to the drastic reduction in adjustment times, and to the possibility to install it in any existing machine of the manually-adjusted type.

The device according to the invention is susceptible of numerous modifications and variations, all of which are within the scope of the inventive concept expressed in the accompanying claims. All the details may be replaced with other technically equivalent ones, all of which are understood to be equally protected.

For example, the single electric servomotor 16 may be replaced with one or more hydraulic pistons which act on the belt 20. As an alternative, it is possible to provide for each threaded post electrical, pneumatic or hydraulic servomotors which are independent and controlled by a suitable electronic circuit.

I claim:

1. Device for automatically adjusting the staking pressure in staking machines for leather and industrial hides, comprising at least one fixed plate and at least one moving plate which face each other and are provided with complementarily shaped tools, wherein said fixed plate is installed on threaded posts which can be screwed in complementarity threaded bushes which are rigidly coupled to a bed, locking devices being provided which act selectively on said fixed plate in order to lock it in the intended position; at least one servomechanism rigidly coupled to said fixed plate and connected to said threaded posts by transmission elements for the automatic rotation of said threaded posts, sensor devices for detecting the value of the maximum penetration of the tools and for generating a first electrical signal (S1); electronic control devices for comparing said first electrical signal (S1) with a presettable second electrical signal (S2) which corresponds to the intended staking pressure and for continuously adjusting the power supply of said servomechanism, wherein said transmission elements are rigidly coupled to the respective posts by bolts which can be released in order to allow manual rotation of said posts.

2. Device according to claim 2, wherein said servomechanism is connected to said threaded posts through at least one flexible transmission device.

3. Device according to claim 2, wherein said flexible transmission device is taken from the group consisting of a toothed belt and a chain.

4. Device according to claim 3, wherein each of said threaded posts has, towards a respective upper end, a toothed pulley on which said flexible transmission device acts.

5. Device according to claim 4, wherein said servomechanism includes a gearmotor provided with a toothed sprocket on which said flexible transmission device acts with the aid of guiding pulleys and tensioner rollers.

6. Device according to claim 5, wherein said transmission elements comprise the respective toothed pulleys at the upper ends of said threaded posts.

7. Device according to claim 1, wherein said sensor devices are constituted by a position transducer which is interposed between the plates.

8. Device according to claim 7, wherein said servomechanism includes a gearmotor having a power supply, said electronic control devices comprising an electronic differential circuit which is suitable to compare said first electrical signal (S1) and said second electrical signal (S2) in order to generate an error signal (e) which adjusts the power supply of said gearmotor.

9. Device according to claim 8, further comprising devices to allow a user to vary said second electrical signal (S2) and to visualize it on a digital display.

10. Device according to claim 1, wherein said locking devices include hydraulic jacks which act selectively on the fixed plate in order to force said threaded posts against the respective bushes, and further comprising devices for the hydraulic control of a supply pressure of the jacks.

11. Device according to claim 10, wherein said hydraulic control devices comprise a controlled electric valve which is arranged along a return line of a supply circuit of the jacks in order to discharge the fluid toward a reservoir.

12. Device according to claim 11, wherein said pressure adjustment devices comprise a pressure reduction valve which is arranged downstream of said controlled electric valve in order to keep the pressure at a set minimum value in order to balance said fixed plate and minimize the force required for the rotation of the threaded posts.

13. Device according to claim 12, further comprising a differential pressure switch which is suitable to detect the pressure in the jack supply circuit and to allow the actuation of said gearmotor only at said minimum pressure.

14. Device according to claim 1, wherein said servomechanism is electromechanical and comprises a gearmotor.

15. Device according to claim 1, wherein said servomechanism is taken from the group consisting of hydraulic and pneumatic and comprises at least one cylinder having a stem.

16. Device for automatically adjusting the staking pressure in staking machines for leather and industrial hides, comprising:

at least one fixed plate;

at least one movable plate, said fixed plate and said movable plate facing each other, said fixed plate and said movable plate being provided with complementarily shaped tools;

a plurality of threaded posts, said fixed plate being installed on said threaded posts;

a plurality of bushes rigidly coupled to a bed and threaded complementarily with respect to said posts, said threaded posts being screwed in said bushes;

locking devices acting selectively on said fixed plate in order to lock it in an intended position;

at least one servomechanism rigidly coupled to said fixed plate, said servomechanism having a power supply;

a synchronous mechanical power transmission train connecting said servomechanism to said threaded posts for the automatic and synchronous rotation thereof sensor devices for detecting a value of a maximum penetration of the tools and for generating a first electrical signal; and electronic control devices operatively connected to said sensor devices for comparing said first electrical signal with a presettable second electrical signal which corresponds to the intended staking pressure and for continuously adjusting said power supply.

17. Device for automatically adjusting the staking pressure in staking machines for leather and industrial hides, comprising:

at least one fixed plate;

at least one movable plate, said fixed plate and said movable plate facing each other, said fixed plate and said movable plate being provided with complementarily shaped tools;

a plurality of threaded posts, said fixed plate being installed on said threaded posts;

a plurality of bushes rigidly coupled to a bed and threaded complementarily with respect to said posts, said threaded posts being screwed in said bushes;

locking devices acting selectively on said fixed plate in order to lock it in an intended position;

at least one servomechanism rigidly coupled to said fixed plate and connected to said threaded posts for the automatic rotation thereof, said servomechanism having a power supply, said servomechanism being taken from the group consisting of hydraulic and pneumatic, said servomechanism including at least one cylinder having a stem;

sensor devices for detecting a value of a maximum penetration of the tools and for generating a first electrical signal; and electronic control devices operatively connected to said sensor devices for comparing said first electrical signal with a presettable second electrical signal which corresponds to the intended staking pressure and for continuously adjusting said power supply.

* * * * *